United States Patent [19]

Gien

[11] Patent Number: 4,591,004

[45] Date of Patent: May 27, 1986

[54] PNEUMATIC PERCUSSION MACHINE

[76] Inventor: Bernard L. Gien, 60 van Beek Street, New Doornfontein, South Africa, 2094

[21] Appl. No.: 610,683

[22] Filed: May 16, 1984

[30] Foreign Application Priority Data

May 18, 1983 [ZA] South Africa ..... 83/3564

[51] Int. Cl.[4] ..... B25D 17/00; E21B 1/00

[52] U.S. Cl. ..... 173/17; 173/73; 173/116; 175/296

[58] Field of Search ..... 173/78, 80, 77, 136, 173/138, 16, 17, 121, 119, 116; 175/296

[56] References Cited

U.S. PATENT DOCUMENTS

| | | | |
|---|---|---|---|
| 2,800,884 | 7/1957 | Mori | 173/138 X |
| 2,947,519 | 8/1960 | Feucht | 175/296 X |
| 3,361,219 | 1/1968 | Sears | 173/80 X |
| 4,084,647 | 4/1978 | Lister | 173/80 X |
| 4,094,366 | 6/1978 | Gien | 173/138 X |
| 4,098,352 | 7/1978 | Kita | 173/78 X |
| 4,159,040 | 6/1979 | Kostylev et al. | 173/136 X |

*Primary Examiner*—Stephen J. Novosad
*Assistant Examiner*—David J. Bagnell
*Attorney, Agent, or Firm*—Abelman Frayne Rezac & Schwab

[57] ABSTRACT

A pneumatic percussion machine has chambers at its ends with air inlet and exhaust passages thereto, controlled by a piston reciprocable between the chambers, an air supply passage from an axially adjacent end chamber to a third chamber being opened only after the air supply to the other end chamber is closed off.

12 Claims, 1 Drawing Figure

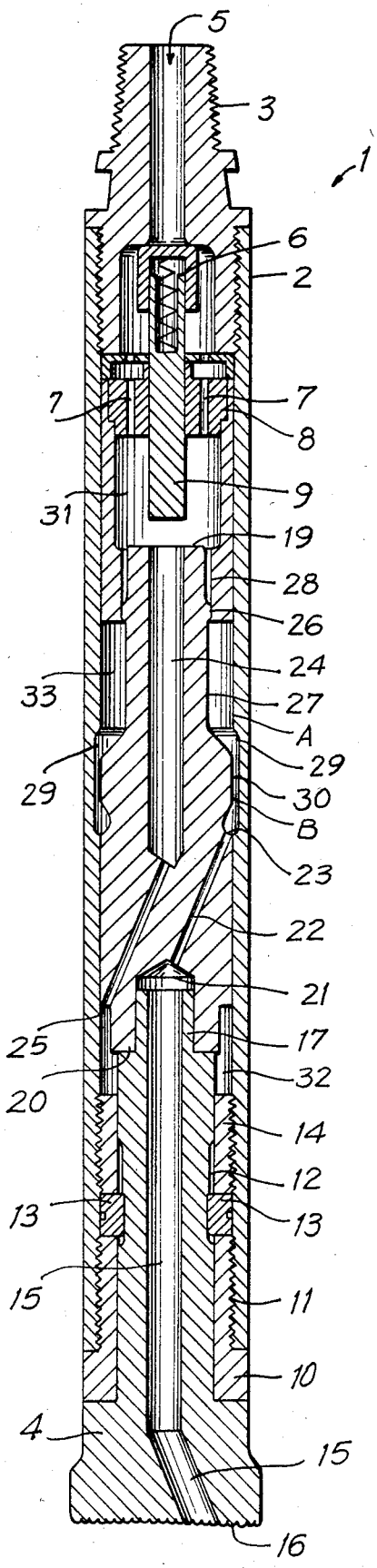
5
3
1
6
2
7
7
8
31
9
19
28
26
24
33
27
A
29
29
30
B
23
22
21
25
17
32
20
14
12
13
13
15
11
10
4
15
16

PNEUMATIC PERCUSSION MACHINE

FIELD OF THE INVENTION

This invention relates to pneumatic percussion machines, and particularly to such machines which are suitable for use as drilling hammers.

BACKGROUND OF THE INVENTION

One problem with conventional high pressure pneumatic drilling hammers, is that they permit too much compressed air to pass through the working parts, and thus do not make fully economical use of the compressed air.

This problem arises because the passages used to convey fluid to the chambers for reciprocating the piston, are lengthy, and usually comprise cutouts within the internal diameter of the sleeve. The chambers are filled and emptied with every stroke of the piston, whereas this is not strictly necessary for the functioning of such a hammer drill.

SUMMARY OF THE INVENTION

It is the object of this invention to provide an efficient and effective pneumatic percussion machine.

In accordance with this invention there is provided a pneumatic percussion machine having an elongated hollow casing having a bit asssembly at one end and a backhead at the other end, the backhead having a compressed fluid inlet, and the bit assembly having an exhaust passage for compressed fluid, a control rod extending into the casing area from the backhead, a piston reciprocable within the casing between the casing ends, and having an opening in the backhead end along which it can reciprocate in sealing engagement with the control rod, a first chamber formed between the backhead and the piston, a second chamber formed between the bit assembly and the piston with the piston in contact with bit assembly, fluid supply paths from the inlet to the chambers provided through and around the piston, being opened and closed by relative movement of cooperating sealing formations on the piston and casing walls, and by the control rod and piston surfaces associated therewith, fluid exhaust paths from the chambers to the exhaust outlet, being opened and sealed by said cooperating sealing formations and by further cooperating sealing formations on the piston and the bit assembly, the movement of the piston under force of compressed fluid alternately opening and sealing the fluid supply paths and their associated exhaust paths to cause continuing piston reciprocation to strike the bit assembly, the fluid supply path to the second chamber passing through the first chamber, and a third chamber is formed around the piston axially adjacent the first chamber, and a fluid supply path is provided from the first to the third chamber, which path is opened in use only at least after the fluid supply path to the second chamber is sealed off.

Further features of the invention provide for there to be a first set of cooperating sealing formations on the piston and casing wall at the backhead end thereof, for sealing and opening the first chamber in selected positions of piston reciprocation, and for the third chamber to be sealed and opened at the backhead end by the said first set of sealing formations. The third chamber is preferably sealed and opened at the other end at selected positions of piston reciprocation by a second set of cooperating sealing formations on the piston and casing walls, which second set of sealing formations open and seal the third chamber from an exhaust passage passing through the piston to the exhaust outlet in the bit assembly.

There is also provided for the second chamber to have inlet and sealing formations provided by the sealing engagement between the control rod and associated piston surfaces, and for a third set of sealing formations on the piston and bit assembly to seal and open the exhaust passage from the third chamber to the exhaust outlet in the bit assembly.

There is further provided for the control rod and associated piston surfaces, and the said first set of sealing formations, to be adapted to cause, after the fluid supply path to the third chamber is sealed off, a time delay during which the piston continues in its movement before the fluid supply path from the first to the third chamber is opened.

The above and additional features of the invention are described below with reference to a preferred embodiment of the invention, which is made by way of example only.

DESCRIPTION OF THE SINGLE DRAWING

The accompanying drawing, is a cross-sectional elevation of a drill hammer according to the invention.

DESCRIPTION OF THE PREFERRED EMBODIMENT

As illustrated, a percussion drill hammer 1 comprises an elongated hollow cylindrical casing 2 having a backhead 3 at one end and a drill bit assembly 4 at the other end. The backhead 3 has an axial opening 5 for a fluid inlet, which leads to a spring check valve assembly 6 and through a narrow passage 7 in an end wall 8 of the backhead, and into the interior of the casing. The end wall 8, also holds a control rod 9 which extends axially within the casing interior.

At the other end of the casing, the drill bit assembly 4 is held in a chuck 10 which is secured in the end of the casing by means of screw threading 11. The drill bit has a stepped annular recess 12 in the length of its shaft, and a bit retaining ring 13 is provided between the internal end of the chuck and a guide bush 14. The retaining ring 13 seats in the stepped annular recess 12, allowing the bit to slide axially within the axial length of the recess, being restrained at each end of its travel by the retaining ring 13. The drill bit assembly has an axial exhaust passage 15 therethrough which is opened to atmosphere at the drill bit head end 16. The interior end of the drill bit has a stepped end section 17.

A piston is provided for reciprocation within the casing ends and has a backhead end 19 and a bit assembly end providing the striking end 20 for striking the internal end of the bit.

The striking end of the piston has a central bore 21 which fits in sealing and sliding engagement around a stepped portion 17 of the internal end of the bit. The striking end 20 of the piston thus strikes against the radial portion of the stepped portion 17 of the bit.

The central bore 21 connects with an inclined passage 22, which extends away from the striking end 20 at an angle to the piston axis, to exit at the periphery of the piston in a middle region thereof.

The backhead end 19 of the piston also has an axial bore 24 which extends toward but not necessarily past the exit 23, and from its internal end also has an inclined passage leading away therefrom to exit at 25 at a position preferably but not necessarily removed from the striking end 20 of the piston. The striking end 20 is also preferably but not necessarily stepped, and the exit 25 is located at the radial section of the stepped portion.

Three sets of sealing formations on the piston and the remainder of the drill are provided.

The first set is located at the backhead end of the piston and on the piston, and comprises an outwardly stepped ring 26 extending radially outwardly from an inwardly stepped section 27 on the backhead end of the piston. This outwardly stepped ring 26 is slidable into and out of a radially inwardly stepped chamber divider ring 28 which is part of a chamber divider positioned inside the casing. The ring 28 cooperates with the stepped ring 26 to form the said first set of sealing formations. When the stepped ring 26 is positioned within the inwardly stepped chamber divider ring 28, this sliding fit provides a seal between the cylindrical casing and the piston.

Towards the middle region of the cylindrical casing, an annular recess 29 is cut in the inner wall of the cylindrical casing. The piston has a corresponding radially outwardly projecting annulus 30, which seals against the casing wall, but not against the stepped wall of the recess 29. The exit 23 is located on the striking head side of the annulus 30. The casing recess 29 and annulus 30 form the second set of sealing formations.

The third set of sealing formations comprises the inwardly stepped portion 17 of the bit which is slidable into the central bore 21, in sealing engagement with the bore surfaces.

Three chambers are formed between the casing and the piston, and which are sequentially opened and sealed during reciprocation of the piston by the three sets of sealing formations.

The first chamber 31 is defined by the backhead end wall 8, the inner wall of the chamber divider ring 28, and the backhead end 19 of the piston.

A second chamber 32 is formed at the bit assembly end of the drill, between the internal end of the bit 4, the inner wall of the casing 2, the striking end 20 of the piston, and the bit guide bush 14.

A third chamber 33 is formed axially adjacent the first chamber 31, and is defined by the end wall of the chamber divider 28 on the bit assembly slide and the inner wall of the casing, and extends from the chamber divider ring 28 to the annular recess 29.

A first fluid supply passage is provided from the axial opening 5 and past the spring check valve, through the passages 7, and into the first chamber 31, past the control rod. The first passage continues into the axial bores 24 in the piston, through the inclined passage and out of the exit 25 thereof and into the second chamber 32.

In the raised position of the piston, a second fluid supply passage is provided from the first chamber 31, past the first set of sealing formations 26 and 28, along the stepped section 27, and into the third chamber 33.

A first fluid exhaust path from the second chamber is provided by the third set of sealing formations between drill bit and piston end, and the drill bit exhaust passage 15.

A second fluid exhaust path from the third chamber is provided by the second set of sealing formations 29 and 30, the opening 23, the inclined passage 22, the axial bore 21 at the bit end of the piston, and from there into the exhaust passage 15 of the bit.

In use, and with the piston positioned at the bit end of the casing and in contact with the internal end of the drill bit, the second chamber 32 is open only to the exit 25 of the first fluid passage. The third set of sealing formations 17 and 21 seal off the exhaust passage 15.

In this position, compressed air entering the backhead inlet 5 follows the first fluid supply path to the second chamber. The compressed air entering the second chamber causes the piston to lift, and move towards the other end of the casing. For this to occur, the area of piston exposed within the second chamber, must be greater than the area of the piston exposed to compressed air within the first chamber.

The first set of sealing formations 26 and 28 are in engagement during the initial movement of the piston towards the backhead end, the stepped ring 26 sliding within the stepped chamber divider ring 28 during this initial movement.

Continued movement of the piston towards the backhead and causes the stepped portion 17 of the drill bit to pull out of the bore 21 of the piston, and the first fluid exhaust passage is thus opened. Air from the second chamber is exhausted through the bit assembly via the exhaust passage 15. At the same time, the control rod 9 enters the bore 24 at the backhead end of the piston thus cutting off the first fluid supply path to the second chamber.

Momentum of the piston carries it still further towards the backhead, during which movement both the fluid supply paths are closed. Compressed air within the first chamber 31 provides a cushioning effect on the piston end 19 as travels into this chamber, and progressively dissipates kinetic energy in the piston preparatory to a return stroke of the piston.

Eventually the stepped ring 26 passes out of the chamber divider ring 28 and into the first chamber, at which time the second fluid supply path from the first chamber 31 to the third chamber 33, is opened. At the same time, the outwardly extending annulus 30 of the piston is moving into the third chamber, in order to engage the second sealing portions 29 and 30, and close off the second exhaust passage 22, 23. The compressed air then acts on the piston end within the first chamber and in addition acts on the surfaces of the piston exposed within the third chamber to propell the piston downwardly towards the drill bit.

After the piston has commenced its return movement, the first set of sealing formations 26 and 28 re-engage to seal off the second fluid supply path.

The piston then moves downwardly under its own momentum to reopen the first fluid path to the second chamber, and to close the third set of sealing formations 17 and 21 at the bit end of the piston, and, to eventually impact on the adjacent end of the drill bit to deliver a hammer blow to the drill bit. During this movement, the second sealing formation 30 is moved to a position opposite the cut-out 29, to open the second fluid exhaust passage from the third chamber. The piston repeats its reciprocatory movement as described above.

A position of the drill bit is provided in which the piston is inactive but is still exposed to the supply of compressed air. This position occurs when the drill bit is lifted off the surface to be drilled, and the drill bit 4 drops under the force of gravity as permitted by the bit retaining ring 13.

In this position, the piston moves further downwardly to cause the first set of sealing formations 26 and 28 to open. This provides an exhaust path directly from the first chamber, past the first set of sealing formations 26, 28, into the third chamber 33, and from there to the opening 23, passage 22, bore 21, and out through the exhaust passage 15 in the bit assembly. Thus the entire compressed air supply to the backhead is exhausted, and no piston reciprocation occurs.

The invention provides a drill bit having a cushioned return at the non striking end of the reciprocating path, with a chamber which provides an initial passage for both of the fluid supply paths required to reciprocate the piston. Thus, a minimum of compressed air is exhausted on each stroke of the piston. The invention also allows for minimal passage ways in the longitudinal direction of the casing and piston, thus further reducing wastage of compressed air.

What I claim is:

1. A pneumatic percussion machine comprising:

an elongate hollow casing having a bit assembly at one end and a backhead at the other end, the backhead having a compressed fluid inlet and the bit assembly having an exhaust passage for compressed fluid;

a control rod extending axially into the casing area from the backhead;

a piston reciprocal within the casing area within the casing between the casing ends and having an axial opening in the backhead end along which it can reciprocate in sealing engagement with the control rod, an axial opening in the bit assembly end of the piston communicating with the periphery of the piston, an inwardly stepped circumferential recess situated between the bit assembly end and the backhead end, a first fluid passageway running from the inwardly stepped recess to the bit assembly and axial opening, and having a second fluid passageway running from the backhead end axial opening to the bit assembly end at a position radially adjacent the bit assembly end axial opening;

a first fluid chamber defined by the backhead, the casing and the backhead end of the piston;

a second fluid chamber defined by the bit assembly, the casing and the bit assembly end of the piston;

a third fluid chamber defined by the casing and the inwardly stepped recess of the piston;

a first fluid supply path from the inlet to the second fluid chamber, passing through the first chamber, the backhead end axial opening in the piston and the second fluid passageway when the piston is in sealing engagement with the bit assembly;

a second fluid supply path from the inlet to the third chamber, passing through the first chamber when the piston is in sealing engagement with the control rod;

a first fluid exhaust path from the second fluid exhaust chamber to the bit assembly exhaust passage when the piston is not in sealing engagement with the bit assembly; and, a second fluid exhaust path from the third fluid chamber to the bit assembly exhaust passage through the first fluid passageway when the piston is in sealing engagement with the bit assembly;

wherein the movement of the piston under force of compressed fluid, in use, alternatively opens and seals the fluid supply paths and their associated exhaust paths to cause continuing piston reciprocation and to cause the piston to successively strike the bit assembly.

2. A pneumatic percussion machine as claimed in claim 1 characterised in that there is a first set of cooperating sealing formations in the piston and casing wall at the backhead end thereof, for sealing and opening the first chamber in selected positions of piston reciprocation, the third chamber being sealed and opened at the backhead end by the said first set of sealing formations.

3. A pneumatic percussion machine as claimed in claim 2 further characterised in that the third chamber is sealed and opened at the bit assembly end at selected positions of piston reciprocation by second set of cooperating sealing formations on the piston and casing walls, which second set of sealing formations open and seal the third chamber from an exhaust passage passing through the piston to the exhaust outlet in the bit assembly.

4. A pneumatic percussion machine as claimed in claim 3 further characterised in that the second chamber has inlet and sealing formations provided by the sealing engagement between the control rod and associated piston surfaces and there is a third set of sealing formations on the piston and bit assembly to seal and open the exhaust passage from the third chamber to the exhaust outlet in the bit assembly.

5. A pneumatic percussion machine as claimed in claim 4 further characterised in that the control rod and associated piston surfaces, and the said first set of sealing formations are adapted to cause, after the fluid supply path to the third chamber is sealed off, a time delay during which the piston continues in its movement before the supply path from the first to the third chamber is opened.

6. A pneumatic percussion machine as claimed in claim 2 further characterised in that the control rod and associated piston surfaces, and the said first set of sealing formations are adapted to cause, after the fluid supply path to the third chamber is sealed off, a time delay during which the piston continues in its movement before the supply path from the first to the third chamber is opened.

7. A pneumatic percussion machine as claimed in claim 3 further characterised in that the control rod and associated piston surfaces, and the said first set of sealing formations are adapted to cause, after the fluid supply path to the third chamber is sealed off, a time delay during which the piston continues in its movement before the supply path from the first to the third chamber is opened.

8. A pneumatic percussion machine as claimed in claim 1 further characterised in that the third chamber is sealed and opened at the bit assembly end at selected positions of piston reciprocation by second set of cooperating sealing formations on the piston and casing walls, which second set of sealing formations open and seal the third chamber from an exhaust passage passing through the piston to the exhaust outlet in the bit assembly.

9. A pneumatic percussion machine as claimed in claim 8 further characterised in that the second chamber has inlet and sealing formations provided by the sealing engagement between the control rod and associated piston surfaces and there is a third set of sealing formations on the piston and bit assembly to seal and open the exhaust passage from the third chamber to the exhaust outlet in the bit assembly.

10. A pneumatic percussion machine as claimed in claim 9 further characterised in that the control rod and associated piston surfaces, and the said first set of sealing formations are adapted to cause, after the fluid supply path to the third chamber is sealed off, a time delay during which the piston continues in its movement before the supply path from the first to the third chamber is opened.

11. A pneumatic percussion machine as claimed in claim 8 further characterised in that the control rod and associated piston surfaces, and the said first set of sealing formations are adapted to cause, after the fluid supply path to the third chamber is sealed off, a time delay during which the piston continues in its movement before the supply path from the first to the third chamber is opened.

12. A pneumatic percussion machine as claimed in claim 1 further characterised in that the control rod and associated piston surfaces, and the said first set of sealing formations are adapted to cause, after the fluid supply path to the third chamber is sealed off, a time delay during which the piston continues in its movement before the supply path from the first to the third chamber is opened.

* * * * *